US006439567B1

(12) United States Patent
Ashley

(10) Patent No.: US 6,439,567 B1
(45) Date of Patent: Aug. 27, 2002

(54) CARD GUIDE AND CARD PICKER

(75) Inventor: Keith R. Ashley, Clark, NJ (US)

(73) Assignee: NBS Card Technology, Paramus, NJ (US)

( * ) Notice: Subject to any disclaimer, the term of this patent is extended or adjusted under 35 U.S.C. 154(b) by 40 days.

(21) Appl. No.: 09/686,757

(22) Filed: Oct. 12, 2000

(51) Int. Cl.[7] ..... B65H 3/48

(52) U.S. Cl. ..... 271/42; 271/42; 271/97; 235/478

(58) Field of Search ..... 271/97, 105, 42, 271/141; 235/475, 478; 414/796.6, 795.5

(56) References Cited

U.S. PATENT DOCUMENTS

| | | | | |
|---|---|---|---|---|
| 3,584,867 A | | 6/1971 | Cargill | |
| 3,645,526 A | | 2/1972 | Holecek et al. | |
| 4,397,459 A | * | 8/1983 | Silverberg et al. | 271/105 |
| 4,463,942 A | * | 8/1984 | Newsome | 271/105 |
| 5,050,853 A | | 9/1991 | LaVos et al. | |
| 5,674,454 A | * | 10/1997 | Karl et al. | 422/63 |
| 6,131,817 A | * | 10/2000 | Miller | 235/475 |

* cited by examiner

*Primary Examiner*—Christopher P. Ellis
*Assistant Examiner*—Mark A. Deuble
(74) *Attorney, Agent, or Firm*—Antonelli, Terry, Stout & Kraus, LLP

(57) ABSTRACT

A card guide for holding a stack of cards to be separated, and a card picker for separating a single card from a stack of cards at a first location and moving the separated card to a second location, where each card has substantially the same thickness and substantially the same periphery. The card guide is includes a frame having a periphery sufficiently larger than the card periphery to permit the cards to readily enter the frame while remaining substantially aligned. The card guide has an open front face and an open rear face. The card guide frame includes a bottom member having a card support area with a rear edge and includes a side member having a notch extending substantially the full height of the open rear face and extending from the card support area rear edge toward the front face by a distance at least as great as the thickness of the cards. The bottom member has at least one air hole through it. The center of the air hole is spaced from the card support area rear edge by a distance substantially equal to the thickness of cards, and the air hole diameter can be at least as great as the thickness of the cards. Preferably, a number of air holes is provided, extending in a line parallel to the card support area rear edge. Preferably, also, a second line of such holes is provided parallel to the first line and spaced from the first line by a distance substantially equal to twice the thickness of the cards. The card picker has a picker finger which engages an edge of the end card of the stack of cards and moves such card in the direction of the frame side member so that the card moves through the notch in the side member. An air source supplies air to the air hole, aiding in separating the end card from the stack of cards, while also blowing away debris and removing static electricity.

18 Claims, 4 Drawing Sheets

CARD GUIDE AND CARD PICKER

FIELD OF THE INVENTION

The present invention pertains to a card guide for holding a stack of cards to be separated by a card picker, and to a card picker for separating a single card from a stack of cards at a first location and moving the separated card to a second location. More particularly, the present invention pertains to a card guide and a card picker in which one or more air holes are positioned to permit air to be blown between cards in a stack as the end card of the stack is engaged by the card picker finger so as to assure separation of a single card from the stack of cards and smooth operation.

BACKGROUND OF THE INVENTION

In various operations it is desired to separate a single card from a stack of cards at a first location and move the separated card to a second location. By way of example, U.S. patent application Ser. No. 09/168,856, filed Oct. 9, 1998, the disclosure of which is incorporated herein by reference, discloses a plastic card transport apparatus and inspection system in which a stack of plastic cards, such as identification cards, credit cards, or automatic teller machine cards, is placed in an input tray, and a card picker moves the plastic cards one at a time to a card transport apparatus which transports the cards through an inspection station to an output station selected based on the results of the inspection. Such a system requires that a single card be separated from the stack of cards and transported for inspection. Likewise, a single card might be separated from a stack of paperboard cards and moved to a selected location for printing or other processing. Again, it is necessary to assure that only a single card is separated from the stack at any one time.

SUMMARY OF THE INVENTION

In one aspect, the present invention is a card guide for holding a stack of cards to be separated by a card picker. By "cards" is meant objects having a uniform known thickness and uniform known periphery, such as height and width. The card guide includes a frame having a bottom member, an open front face, and an open rear face. The rear face is adapted to abut a transport surface along which a separated card is to be transported. The frame defines a space having a periphery substantially the same as the periphery of the cards. One side of the frame has a notch extending substantially the full height of the open rear face and extending from the rear face toward the front face by a distance at least as great as the thickness of the cards. The bottom member has at least one air hole through it, with its center spaced from the rear edge of the bottom member by a distance substantially equal to the thickness of the cards and with a radius less than the thickness of the cards. Air from this air hole is blown between the end card and the next card, aiding in separation of the end card from the stack.

Preferably, the frame bottom member has a set of a plurality of air holes through it, for example three air holes, with the air holes being arranged in a line substantially parallel with the rear edge of the bottom member. Also preferably, the bottom member has a second set of air holes through it in a line parallel with the line of the first set of air holes. The line of the second set of air holes is preferably spaced from the line of the first set by a distance substantially equal to twice the thickness of the cards. Air from air holes of this second line is blown between the third card in the pack and the fourth card in the pack, fluttering the cards so that the separation of the end card from the pack is eased. In addition, the air blows away any debris that might be present between the cards, and also removes any static charge on the cards.

In another aspect, the present invention is a card picker for separating a single card from a stack of cards at a first location and moving the separated card to a second location, each card of the stack having substantially the same thickness and substantially the same periphery. The card picker includes a frame of the type set forth above, a picker finger for engaging the end card of the stack of cards on a side of such card and moving that card through the notch in one side of the frame, to move the card along the transport surface. Additionally, the card picker has an air source for supplying air to the air hole or holes.

BRIEF DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF PREFERRED EMBODIMENT

Figure 1:
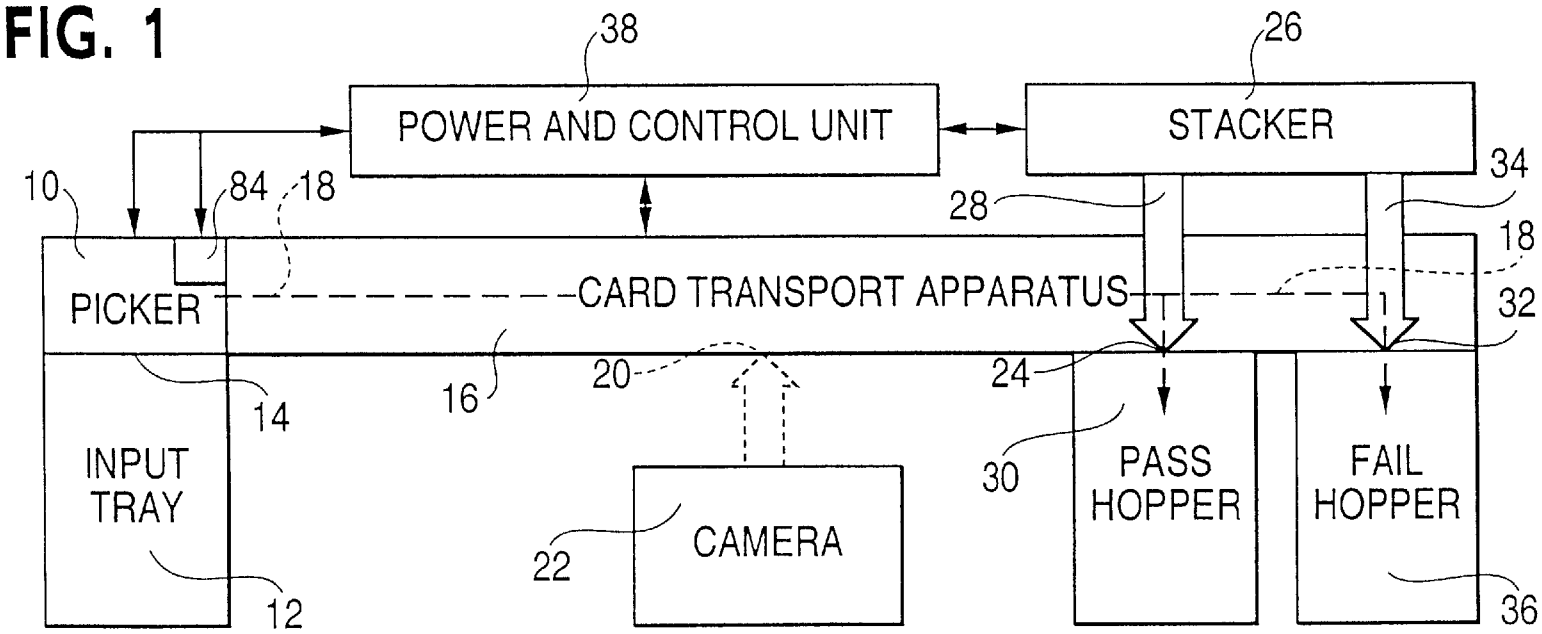
FIG. 1 is a block diagram depicting a typical card transport system in which a card picker in accordance with the present invention might be utilized.

FIG. 1 depicts in block diagram form a card inspection system in which a card picker 10 in accordance with the present invention might be incorporated. Cards to be inspected are stacked in an input tray 12 which includes a biasing arm or other means for urging the cards toward card input location 14. Picker 10 separates one card at a time from card input location 14 and feeds that card to card transport apparatus 16 in which the card is transported along path 18. In the illustrative system of FIG. 1, path 18 brings the card past a card inspection location 20. The card is then inspected, for example by a digital camera 22. The card is then transported further along path 18 to a first card output location 24. If the inspection shows that the card meets specified criteria, then a stacker 26 activates an ejector 28 to discharge the card by ejecting the card to a first output hopper 30. On the other hand, if the inspection shows that the card does not meet the specified criteria, or that the card meets a second set of inspection criteria, then card transport apparatus transports the card further along path 18 to a second card output location 32, and stacker 26 activates a second ejector 34 to discharge the card by ejecting the card to a second output hopper 36. By way of example, picker 14, card transport apparatus 16, camera 22, and stacker 26 may be controlled by power and control unit 38 which also compares the various parameters of the card with inspection criteria in a memory within the power and control unit. When the card inspection system is inspecting various parameters of newly manufactured cards to determine whether they are acceptable, for example whether their writing, logo, hologram, magnetic strip, signature panel, bar code, or other features are clean and proper, then first output hopper 30 might be a pass hopper and second output hopper 36 a fail hopper, as indicated in FIG. 1. Cards that pass the inspection are ejected by stacker 26 to pass hopper 30, while cards that fail the inspection are ejected to fail hopper 36.

Figure 2:
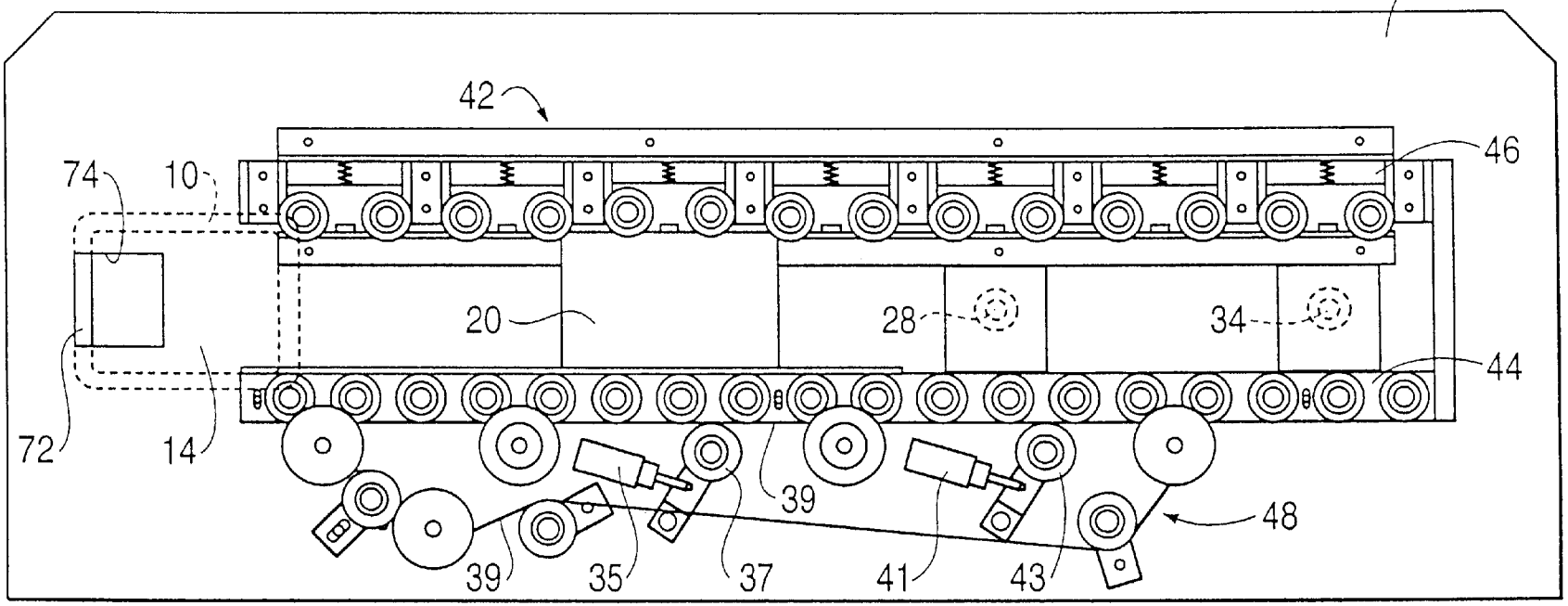
FIG. 2 is a plan view of a transport apparatus which might be utilized in the system of FIG. 1.

FIG. 2 illustrates a typical card transport apparatus 16 which includes a back panel 40 and a conveyor mechanism 42. Conveyor mechanism 42 includes a lower run 44 of rollers and an upper run 46 of rollers. A drive mechanism 48 selectively drives rollers on lower run 44 to transport cards along the card transport apparatus. Further details of a typical card transport apparatus can be found in U.S. patent application Ser. No. 09/168,856. FIG. 2 also illustrates the position of card picker 10 relative to card transport apparatus 16, permitting feeding of cards to the card conveying mechanism 42. In addition, FIG. 2 illustrates the positions of card input location 14, card inspection location 20, ejector 28 and ejector 34. When a card has reached card inspection location 20, power and control unit 38 activates solenoid 35 to momentarily move wheel 37 away from drive belt 39, stopping movement of the card while the card is inspected by camera 22. When power and control unit 38 determines that a card is to be ejected at first card output location 24 and the card reaches that location, unit 38 activates solenoid 41, to move wheel 43 away from drive belt 39 to stop movement of the card, and stacker 26 activates a motor, solenoid, or similar mechanism to cause ejector 28 to push the card from card transport apparatus 16 to output hopper 30. If power and control unit 38 determines that the card is not to be ejected at first output location 24, then when the card reaches second card output location 32, unit 38 activates stacker 26 to eject the card to output hopper 36.

Figure 3:
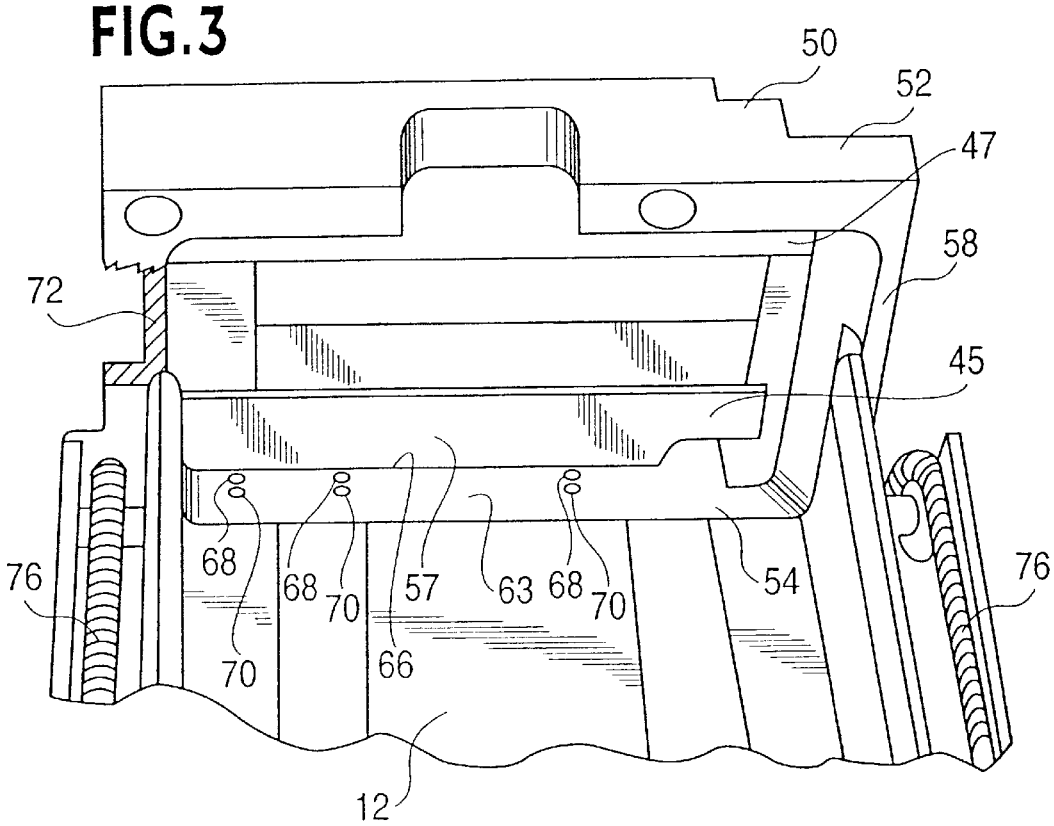
FIG. 3 is a perspective view, partially broken, of a card picker in accordance with a preferred embodiment of the present invention, particularly suited for use with the card transport apparatus of FIG. 2.
Figure 4:
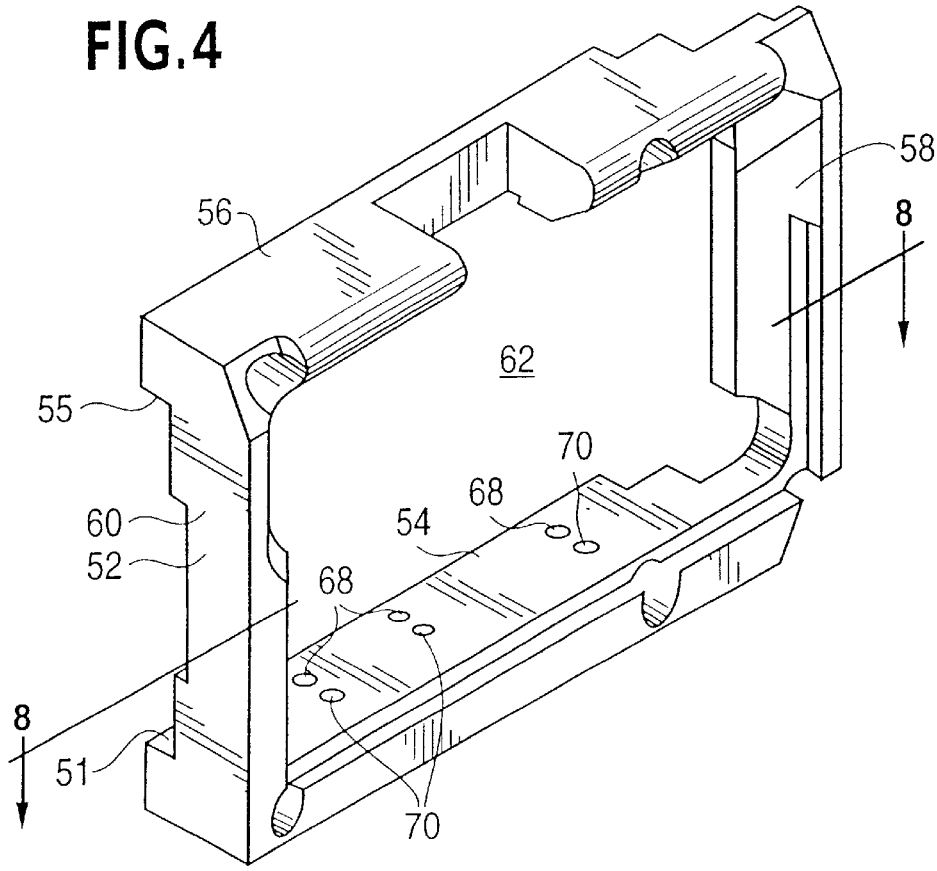
FIGS. 4, 5, and 6 are perspective views of components of a card guide in accordance with a preferred embodiment of the present invention, particularly suited for use with the card picker of FIG. 3.

FIG. 3 is a perspective view, partially broken, of a card guide 50 in accordance with a preferred embodiment of the present invention, suitable for use to move rectangular cards, for example wallet size credit cards, from card input location 14, at the end of card input tray 12, onto conveyor mechanism 42. Card guide 50 includes a frame 52 which, as shown in FIG. 4, includes a bottom member 54, a top member 56, and first side member 58, and a second side member 60. Members 54–60 define a central space 62, the front and rear faces of which are open. The cards to be inspected have a known thickness and a known periphery. For example, the cards might have a thickness in the order of 0.030 inch and might be substantially rectangular, with a width in the order of 3.375 inches and a height in the order of 2.125 inches, with rounded corners. Other sizes and shapes might be found, and the cards need not necessarily be rectangular or square, but could have any desired shape, with the card guide having a corresponding shape. Space 62 within frame 52 has a periphery just slightly larger than the periphery of the cards to be separated by an amount permitting the cards to readily fit within space 62, allowing the cards to enter frame 52 while maintaining the cards substantially aligned. Thus, for example, if rectangular cards as described above are to be separated, then space 62 preferably is rectangular with a width in the order of about 3.392 inches and a height in the order of about 2.147 inches, permitting the cards to fit within the space 62.

Figure 5:
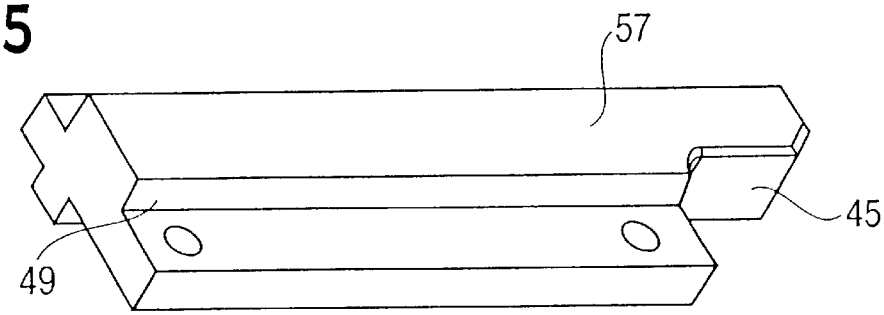
Figure 6:
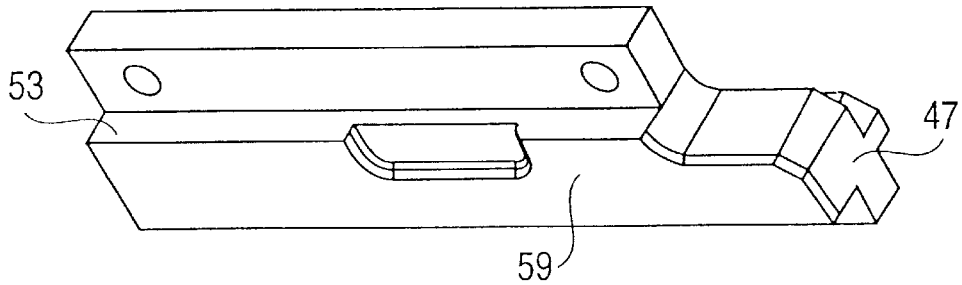

Card guide 50 further includes a bottom spacer 45 and a top spacer 47 which are depicted in FIGS. 5 and 6 respectively. Bottom spacer 45 fits behind bottom member 54 of frame 52, with surface 49 of bottom spacer 45 abutting surface 51 of the bottom member 54. Similarly, top spacer 47 fits behind top member 56, with surface 53 of top spacer 47 abutting surface 55 of top member 56. Front surface 57 of bottom spacer 45 and front surface 59 of top spacer 47 then extend forwardly into space 62 to position the cards for movement onto conveyor mechanism 42. Front surface 57 of bottom spacer 47 thus defines a card support area 63 on bottom member 54, shown in FIG. 3, on which the end-most cards of the stack are supported. The particular shape and configuration of card guide 50 is, of course, dependent upon the shape of the particular cards to be picked and also the location to which the cards are to be moved. While card guide 50 is depicted as formed of frame 52, bottom spacer 45 and top spacer 47, this is given by way of illustration of a card guide to move credit card-size cards onto conveyor mechanism 42. Other card guides within the scope of the present invention might be formed as one piece. For example, if the cards to be picked can be permitted to abut the surface of the transport mechanism, bottom spacer 45 is unnecessary, and rear edge 66 of card support area 63 coincides with the rear edge of bottom member 54.

In accordance with the present invention, card support area 63 of bottom member 54 on frame 50 has at least one air hole passing through it. Preferably, as illustrated in FIGS. 3 and 4 there is a first set of air holes 68 arranged in a line substantially parallel with rear edge 66 of card support area 63. The number of air holes in the line depends upon the width of the cards to be picked. For cards 3.375 inches wide, three air holes are preferred. Preferably, each hole 68 has its center spaced from rear edge 66 of card support area 63 by a distance substantially equal to the thickness of the cards. Each hole can have a diameter substantially equal to the thickness of the cards, but it is preferred that the hole diameter be slightly greater than the card thickness in case of a slight misalignment of the holes or deviation in the card thickness. Thus, for example, for cards having a thickness of 0.030 inch, the holes 68 are preferably aligned in the order of about 0.030 inches from rear edge 66 and preferably have a diameter in the order of about 0.040 inch. Preferably, also, a second set of aligned holes 70 is provided through bottom member 54. Each hole 70 is preferably aligned with a corresponding hole 68, but this is not essential. Preferably, the alignment of the holes 70 is spaced from the alignment of the holes 68 by a distance substantially equal to twice the thickness of the cards. Thus, in the representative example of FIGS. 3 and 4, each hole 70 is in the order of about 0.060 inch from a corresponding hole 68. The holes 70 can have the same diameter as holes 68, but this is not essential.

Figure 7:
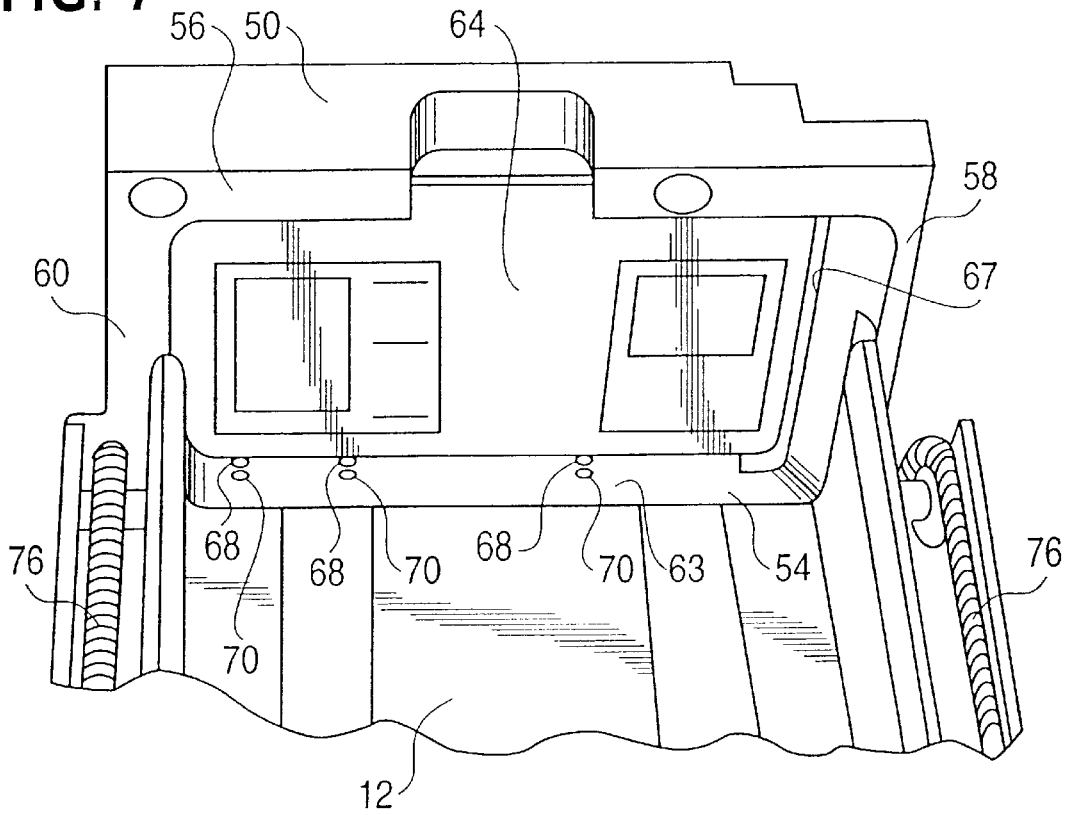
FIG. 7 is a perspective view of the card picker of FIG. 3, showing a typical card within the card guide.

FIG. 3 depicts card guide 50 positioned at the input location 14 on input tray 12, with no cards in the card guide or input tray, and FIG. 7 is a similar view, but showing a single card 64 within card guide 50. That card covers approximately one-half of each hole 68. As can be seen particularly in FIG. 7, first side member 58 is provided with a notch 67 adjacent the rear face of card guide 50. Notch 67 extends substantially the full height of the open rear face of card guide 50 and extends forward toward the open front face to a point spaced forward of rear edge 66 by a distance at least as great as the thickness of the cards 64 to be separated. As seen in FIGS. 2 and 3, a picker finger 72 extends through an opening 74 in back panel 40, coming forward of rear edge 66 by a distance not greater than, and preferably substantially equal to, the card thickness. Picker finger 72 operates under the control of power and control unit 38.

Figure 8:
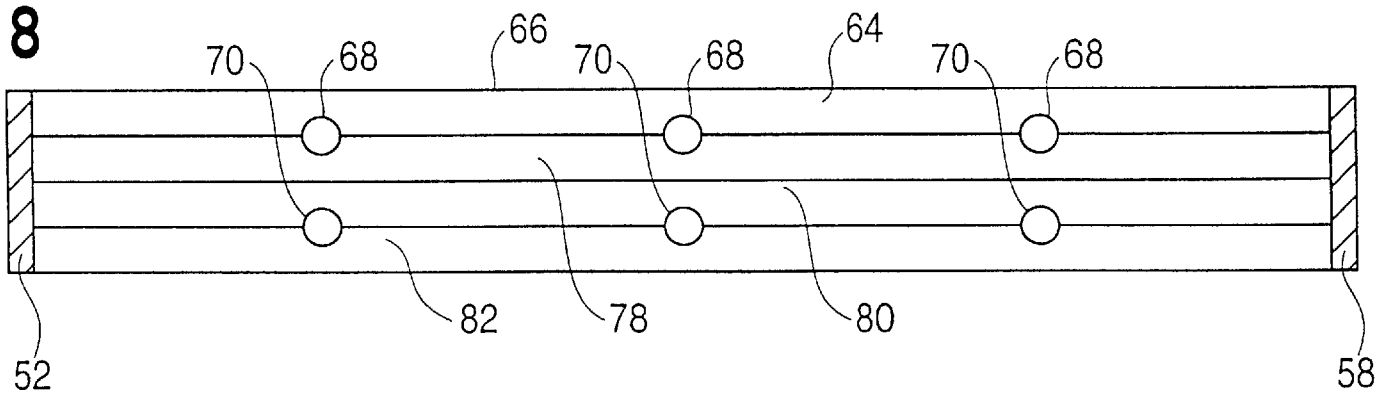
FIG. 8 is a sectional view taken along lines 8—8 of FIG. 4, and additionally showing the positions of representative cards within the card guide.

Preferably, input tray 12 includes a pusher plate (not shown) which is urged by springs 76 toward card input location 14 to push the stack of cards into card guide 50. FIG. 7 depicts a card 64 which has been positioned at the end most position on card rest area 63 within card guide 50 by the urging of the pusher plate. FIG. 8 is a diagrammatic view depicting the positions of cards 64, 78, 80, and 82 on card rest area 63 of bottom member 54, together with air holes 68 and 70. As can be seen in FIGS. 7 and 8, the holes 68 of the innermost set of holes lie between the end most card 64 and the next card 78, while the holes 70 of the second line of holes lie between the third card 80 and the fourth card 82. An air supply 84 (FIG. 1) under the control of power and control unit 38 provides air to holes 68 and 70. Air passing through holes 68 flows between the end most card 64 and the next card 78, easing the separation of those two cards from each other. Air passing through holes 70 flows between cards 80 and 82, fluttering those cards so as to prepare them for separation. In addition, the air blows away debris trapped between the cards and removes static electricity.

To separate a single card from a stack of cards on input tray 12, with the cards being urged toward card input location 14 by springs 76 and the pusher plate, power and control unit 38 activates air source 84 to cause air to blow through air holes 68 and 70. Power and control unit 38 then activates picker finger 72 which engages the end card 64 of the stack of cards on a side edge of card 64 adjacent second side member 60 of frame 50. Picker finger 72 moves card 64 through notch 67 in first side member 58. In the illustrative card transport apparatus of FIGS. 1 and 2, the card moves to conveyor mechanism 42 of card transport apparatus 16, is inspected at card inspection location 20, and is discharged at the appropriate one of output locations 24 and 32. In other applications, the separated card would be moved to another appropriate location.

The present invention thus provides an improved card guide and a card picker that more assuredly separates a single card from stack of cards. Although the invention has been described with reference to preferred embodiments, various alterations, rearrangements, and substitutions can be made, and still the result will be within the scope of the invention.

What is claimed is:

1. A card guide for holding a stack of cards to be separated by a card picker, each card having substantially the same thickness and substantially the same periphery, said card guide comprising a frame having a periphery sufficiently larger than the card periphery to permit the cards to enter said frame while maintaining the cards substantially aligned, said frame including a bottom member with a card support area having a rear edge, and including a side member, said frame having an open front face and an open rear face, the rear face adapted to abut a transport surface, said card guide being adapted to hold a plurality of cards from the stack with a bottom edge of each card supported on the card support area of said bottom member, said side member having a notch extending substantially the full height of the open rear face and extending from the card support area rear edge toward the front face by a distance at least as great as the thickness of the cards, said bottom member having an air hole therethrough, the air hole having a center spaced from the card support area rear edge by a distance substantially equal to the thickness of the cards and having a diameter at least as great as the thickness of the cards.

2. A card guide as claimed in claim 1, wherein the diameter of the air hole is greater than the thickness of the cards.

3. A card guide as claimed in claim 1, wherein the frame bottom member has a plurality of air holes therethrough, the air holes being of substantially equal size and being arranged in a line extending substantially parallel with the rear edge of the bottom member card support area.

4. A card guide as claimed in claim 3, having three air holes.

5. A card guide as claimed in claim 3, wherein the diameter of each air hole is greater than the thickness of the cards.

6. A card guide as claimed in claim 1, wherein the frame bottom member has a plurality of air holes therethrough, the air holes being of substantially equal size and being arranged in two parallel lines spaced apart by a distance substantially equal to twice the thickness of the cards, each line extending substantially parallel with the rear edge of the bottom member card support area.

7. A card guide as claimed in claim 6, wherein each line has three air holes.

8. A card guide as claimed in claim 6, wherein the diameter of each air hole is greater than the thickness of the cards.

9. A card guide as claimed in claim 1, wherein the space is substantially rectangular.

10. A card picker for separating a single card from a stack of cards at a first location and moving the separated card to a second location, each card having substantially the same thickness and substantially the same periphery, said card picker comprising:

a frame having a periphery sufficiently larger than the card periphery to permit the cards to enter said frame while maintaining the cards substantially aligned, said frame including a bottom member with a card support area having a rear edge, and including a side member, said frame having an open front face and an open rear face, the rear face adapted to abut a transport surface, said card guide being adapted to hold a plurality of cards from the stack with a bottom edge of each card supported on the card support area of said bottom member, said side member having a notch extending substantially the full height of the open rear face and extending from the card support area rear edge toward the front face by a distance at least as great as the thickness of the cards, said bottom member having an air hole therethrough, the air hole having a center spaced from the card support surface rear edge by a distance substantially equal to the thickness of the cards and having a diameter at least as great as the thickness of the cards;

a picker finger for engaging an end card of the stack of cards on an edge of such card and moving such card in the direction of said frame side member to move the card along the transport surface and through the notch in said frame first side member; and an air source for supplying air to the air hole.

11. A card picker as claimed in claim 10, wherein the diameter of the air hole is greater than the card thickness.

12. A card picker as claimed in claim 10, wherein the frame bottom member has a plurality of air holes therethrough, the air holes being of substantially equal size and being arranged in a line extending substantially parallel with the rear edge of the bottom member card support surface.

13. A card picker as claimed in claim 12, having three air holes.

14. A card picker as claimed in claim 12, wherein the diameter of each air hole is greater than the card thickness.

15. A card picker as claimed in claim 10, wherein the frame bottom member has a plurality of air holes therethrough, the air holes being of substantially equal size and being arranged in two parallel lines spaced apart by a distance substantially equal to twice the thickness of the cards, each line extending substantially parallel with the rear edge of the bottom member card support area.

16. A card picker as claimed in claim 15, wherein each line has three air holes.

17. A card picker as claimed in claim 15, wherein the diameter of each air hole is greater than the card thickness.

18. A card picker as claimed claim 10, wherein the space is substantially rectangular.

* * * * *